United States Patent [19]

Baikie

[11] 4,074,909

[45] Feb. 21, 1978

[54] ICE SKATE

[75] Inventor: Hugh E. Baikie, Chateauguay Center, Canada

[73] Assignee: Kenbudge Holdings Limited, Montreal, Canada

[21] Appl. No.: 715,617

[22] Filed: Aug. 18, 1976

[51] Int. Cl.[2] ..... A63C 1/02

[52] U.S. Cl. ..... 280/11.12

[58] Field of Search ..... 280/11.12, 11.17, 11.18, 280/11.35

[56] References Cited

U.S. PATENT DOCUMENTS

| | | | |
|---|---|---|---|
| 1,352,113 | 9/1920 | Brown | 280/11.17 |
| 1,749,298 | 3/1930 | Orafsik | 280/11.18 |
| 3,212,786 | 10/1965 | Florjancic et al. | 280/11.12 |
| 3,967,832 | 7/1936 | Chambers | 280/11.12 |

*Primary Examiner*—Philip Goodman
*Assistant Examiner*—Gene A. Church

[57] ABSTRACT

The invention relates to improvements in the construction of ice skates, and provides an ice skate having an elongated blade and a plastic superstructure for holding the blade. The superstructure has a groove for receiving the upper edge of the blade and the blade is held in the superstructure by means of bolts. The bolts have heads designed to fit into recesses in the upper edge of the blade and are secured at their other ends in the plastic superstructure. The heads of the bolts fit snugly into the recesses and the sides of the recesses firmly anchor the heads when the blade is properly positioned in the superstructure. Preferably nuts are used to secure the other ends of the bolts and in this manner a very firm and secure attachment of the blade in the superstructure can be achieved.

21 Claims, 5 Drawing Figures

ICE SKATE

This invention relates to improvements in the construction of ice skates, and more particularly to improvements in the construction of ice skates have blade-supporting superstructures made of plastic material, i.e. a synthetic thermoplastic or thermosetting material.

Attempts have been made in the past to mount the metal blade of an ice skate into a plastic superstructure for attachment to the sole and heel of a skate boot. Conventionally, metal is used for the superstructure but the use of plastic material has been considered desirable to make the skate lighter, cheaper and of more attractive appearance; however, the difficulties encountered have been considerable and a totally satisfactory skate has not been produced. The reasons for this are considered to be as follows.

Firstly, it has proved difficult to mount the blade sufficiently rigidly in the plastic material so that the plastic holds the blade firmly during normal use when considerable forces are applied to the blade. The blade may thus move relative to the superstructure or become misaligned therein or separated therefrom.

Secondly, when plastic material is moulded around a metal insert, such as a blade, the plastic material tends to shrink and as a result moves relative to the metal when the material cools after the moulding step. This is because the plastic material contracts more than the metal, as cooling takes place, which results in structural weakness because of stresses set up in the plastic material.

Thirdly, it has been difficult to produce a superstructure made of plastic material having sufficient strength to withstand the compressive forces resulting from the skater's weight. This is because plastic moulding techniques require wall sections to be thin, as otherwise internal stresses are produced as a result of uneven shrinkage of the plastic on cooling when taken from the mould.

Fourthly, difficulties have sometimes been encountered in the region where the blade contacts the plastic material, because the edges of the blade tend to be quite sharp and during use the blade may cut into the plastic material and form a notch which reduces the structural strength of the skate.

In Canadian Patent No. 585,720 issued on Oct. 27, 1959 to John E. Kirkpatrick et al, a plastic superstructure is moulded around the upper edge of a metal blade. The upper edge of the blade has a number of longitudinally spaced projections having undercut portions which anchor the blade in the plastic. However, this method of attaching the blade suffers from most if not all of the difficulties mentioned above and a satisfactory skate has not been produced.

In U.S. Pat. No. 3,212,786 issued on Oct. 19, 1965 to P. Florjancic et al, a similar skate is described, but additionally, in one embodiment, a method is disclosed of first mouldng the superstructure and then fitting a blade into the superstructure as a separate step. To allow for this, a pair of metal sleeves are embedded into the superstructure during the moulding step and are positioned to receive a pair of upwardly extending projections from the upper edge of the skate blade so that the blade can be force fitted into the superstructure. The upper edge portion of the blade locates in a longitudinal slot in the superstructure when the projections are pressed fully home into the sleeves. The difficulty with this construction is that the blade is not held sufficiently rigidly in the superstructure and the parts are uneconomical to manufacture.

It is an object of the present invention to provide a skate in which the blade is mounted firmly in a superstructure made of plastic material.

It is another object of this invention to provide a skate having a superstructure made of plastic material in which the mouldng of the plastic material around a permanent metal insert, such as the blade, is avoided.

It is yet another object of this invention to provide a skate having a readily-removable and hence replaceable metal blade.

These and other objects and advantages of preferred embodiments of the invention will become apparent from the following description in which reference is made to the accompanying drawings, in which:

FIG. 1 is a longitudinal, generally cross-sectional view of a skate according to one embodiment of the invention, in which the blade, bolts and nuts are shown in elevation;

FIG. 2, which follows FIG. 3 in the drawings, is an enlarged transverse cross-sectional view of the skate shown in FIG. 1 taken on the line II—II, but with parts beyond the section not shown;

Figure 1:
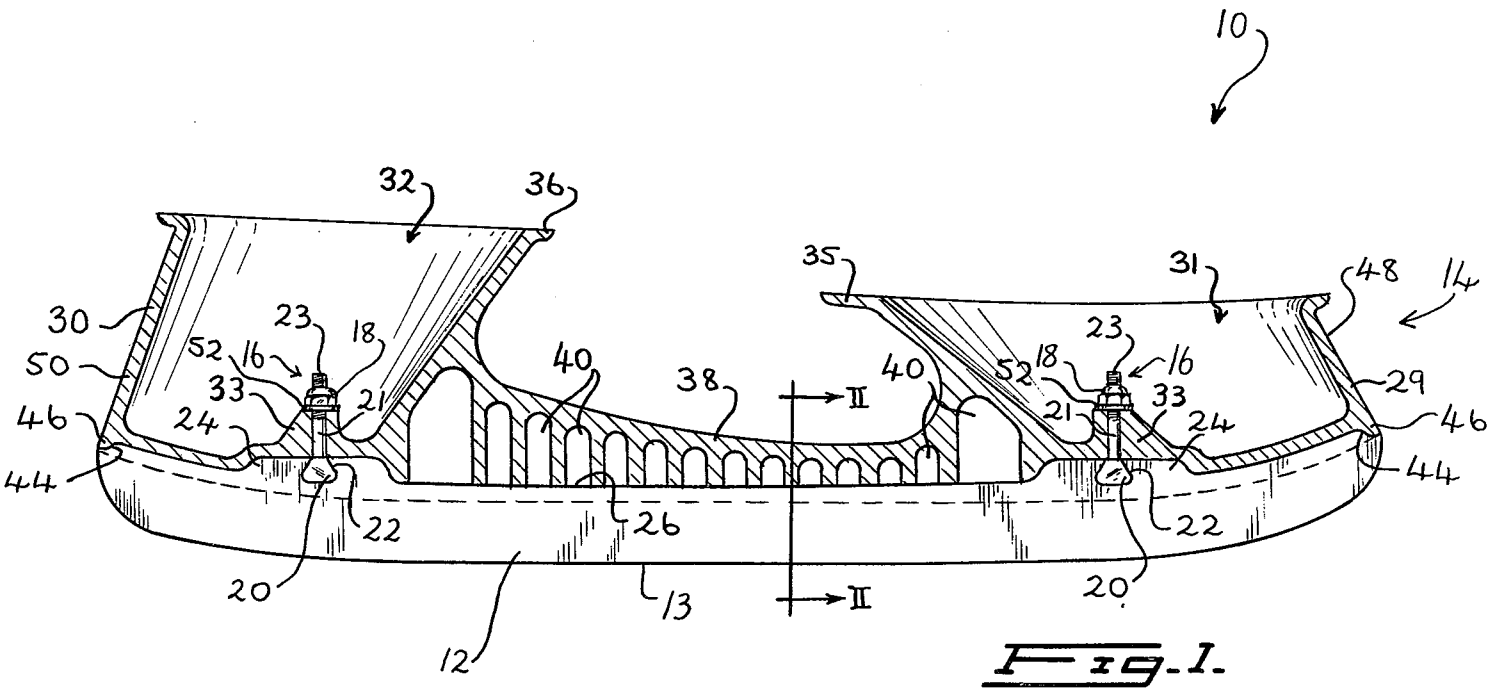

In the embodiment of the invention shown in FIG. 1, a skate is shown generally at 10. The skate consists of two main parts, namely a blade 12, having an ice-engaging edge 13, and a superstructure 14. The blade 12 is made of steel and the superstructure 14 is made of a plastic material. Although the blade 12 can be made of any suitable steel usually used for skate blades, it is an important advantage of this invention that the blade 12 can be made of stainless steel. This advantage is discussed in more detail later. The plastic material used for the superstructure 14 should preferably be a low temperature resistant and high impact resistant plastic such as a suitable polycarbonate or nylon (such as that sold under the trade mark Zytel ST 800). Clearly, the plastic should be sufficiently rigid to support the skaters weight and tough enough to make the superstructure sufficiently durable.

The blade 12 is attached to the superstructure 14 by means of a pair of bolts 16 and a pair of nuts 18. The bolts 16 each have a triangular head 20, a shank 21 and a threaded end 23 and the nuts 18 are internally threaded so that they can be located on the threaded ends 23 in the normal way.

The heads 20 of the bolts 16 are located within generally triangular recesses 22 formed in projections 24 on the upper edge 26 of the blade 12. It can be clearly seen from FIG. 1 that the recesses 22 have restricted throat portions so that the bolt heads 20 are held firmly against upward movement by the sides of the recesses 22. However, the bolt heads 20 can easily be located in the recesses 22 by sideways movement before the blade 12 is inserted in the superstructure 14, but they cannot become disengaged when the blade is fully located in the superstructure.

By this means, the blade 12 is firmly held with its upper edge 26 located in a groove 28 (shown in phantom lines in FIG. 3) formed in the lower edge of the superstructure 14. The nuts 18 and bolts 16 are recessed within toe support 29 and heel support 30 which are hollow and define internal cavities 31 and 32, respectively. These cavities are provided to allow access to the nuts 18 for tightening and slackening purposes, to reduce the amount of plastic necessary for the superstructure and hence the weight and cost of the skate, and to enable the walls of the supports 29 and 30 to be made sufficiently thin that the problems associated with cooling of thick sections of plastic after moulding are avoided. In the region of each bolt 16, which is subject to stress, thin sections are maintained, but adequate strength is nevertheless provided by upwardly extending tubular posts 33 which each define a central passageway, as shown, through which pass the shank portions 21 of the bolts 16.

Figure 3:
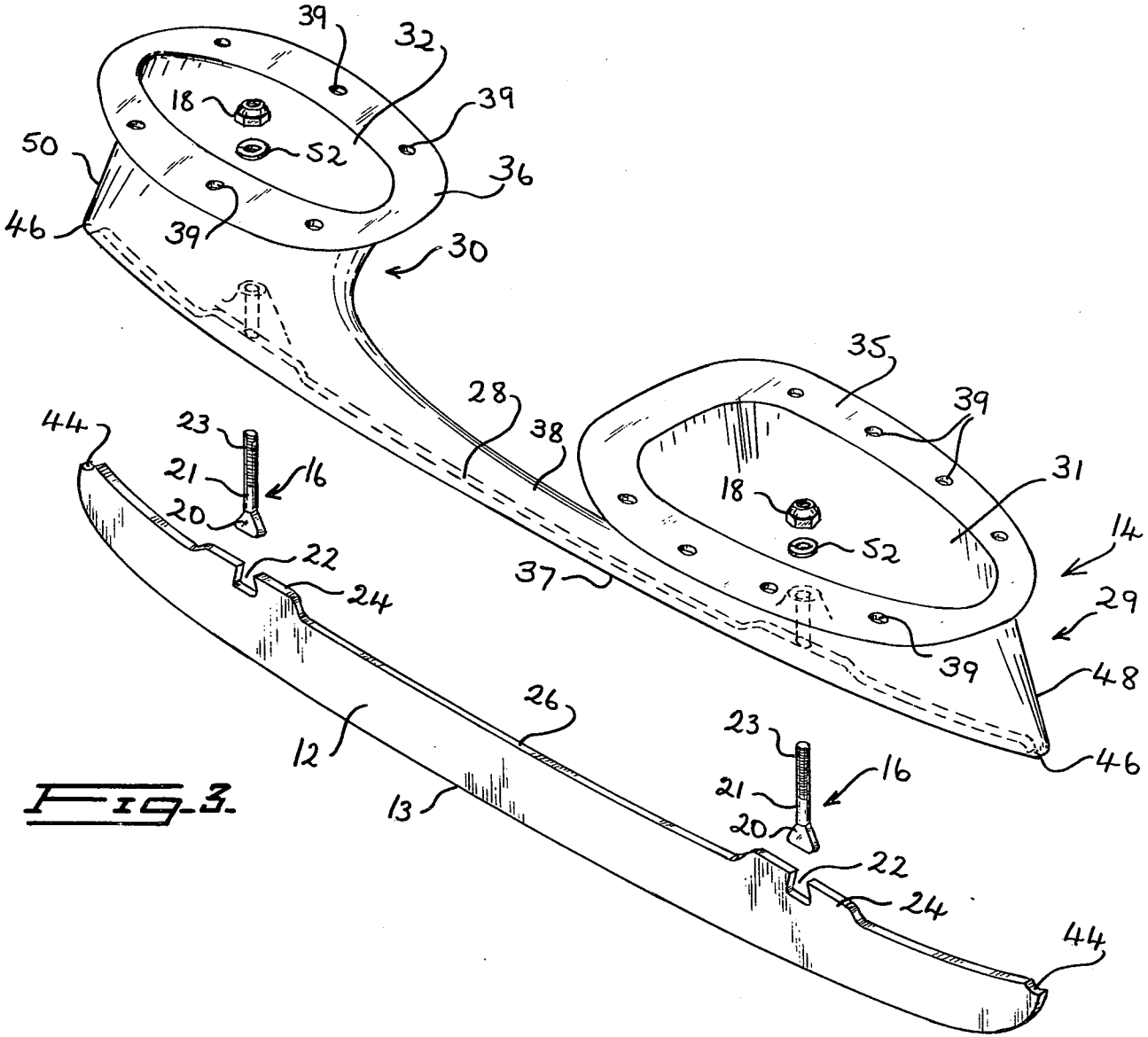
FIG. 3 is an exploded perspective view of the skate shown in FIG. 1.

It is possible to make the walls of the toe support 29 and the heel support 30 quite thin, because, as can be seen best from FIG. 3, these walls have the general characteristics of cones, the bases of which are completed by sole and heel portions of the skater's boot. The result is an especially strong structure. The upper edges of the toe support 29 and the heel support 30 have outwardly turned flanges 35 and 36, respectively, which flanges are used to secure the superstructure 14 to a skate boot (not shown).

The flanges 35 and 36 are best shown in FIG. 3 from which it can be seen that they provide an extensive attachment area, enabling the superstructure 14 to be secured to a boot quite rigidly. This attachment can be achieved in any suitable manner, e.g. by rivetting or by the use of screws or nuts and bolts, etc., for which purpose holes 39 may be provided in the flanges 35, 36.

If an attachment method is used whereby the superstructure 14 is readily removable from the boot, access to the nuts 18 is provided, enabling the blade 12 to be easily replaced by unscrewing the nuts 18 and withdrawing the blade 12 and the bolts 16 downwardly. A new blade can then be inserted and the nuts 18 re-tightened. This is an advantage, since conventional skates quite often have to be discarded when the blades become unserviceable through excessive sharpening or because of rusting or damage, while the superstructure and boot may still be serviceable. By making the blade 12 easily replaceable, therefore, the superstructure 14 need not be discarded when the blade 12 becomes unserviceable. It is therefore advantageous to attach the superstructure 14 to the boot by means, for example, of bolts and nuts or other removable fixing means.

Figure 2:
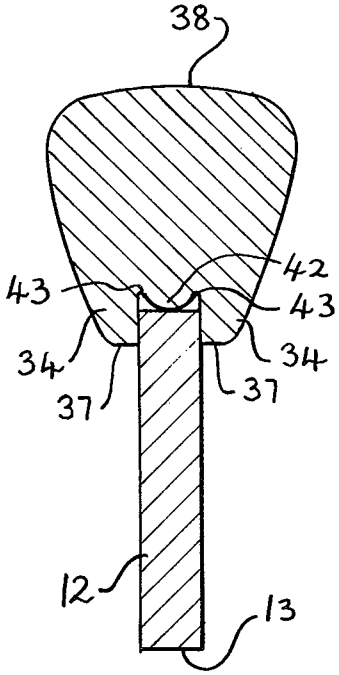

During use of the skate, forces are applied to the blade which tend to knock the blade out of the superstructure 14. For example, a force may be applied which tends to move the blade either longitudinally forwards or backwards relative to the superstructure. This is referred to hereinafter as "kick-out" and is inhibited in this embodiment of the invention by the projections 24, which firmly abut against adjacent parts of the superstructure, and by bolts 16 and nuts 18. Forces are also applied to the blade which tend to make it twist out of its proper plane relative to the superstructure. This twisting would usually take place about a longitudinal axis running from the front to the rear of the skate, but is effectively inhibited by a combination of factors. Firstly, the upper edge 26 of the blade projects into the superstructure as indicated by the phantom line in FIG. 1 which shows the position of the lower edge 37 of the superstructure. Thus, walls 34 (see FIG. 2) resist any twisting motion. Secondly, the projections 24 are more deeply embedded in the superstructure than other parts of the blade, as can be seen in FIG. 1, and hence they provide greater resistance to the twisting motion. Thirdly, the upper edge 26 of the blade is curved in the longitudinal direction, as can be seen from FIG. 1, and this greatly contributes to the inhibition of twisting, because the twisting-resisting forces produced by the walls 34 have greater leverage on the blade than would be the case if the upper edge 26 were straight.

Therefore, despite the fact that the blade 12 may extend into the superstructure 14 by a relatively short distance, e.g. ⅛ of an inch at positions spaced from the projections 24, a rigid and secure connection is nevertheless obtained.

Moreover, a considerable economic advantage results from making the projections 24 of the shape and dimensions shown in the drawings. This is because the blade 12 can be produced, for example, by stamping from a slightly larger stainless steel strip without undue wastage of material, since the projections 24 do not extend upwardly from the blade by a great distance, and clearly the further projections extend upwardly, the greater the amount of material to be removed from around the projections. Thus, by using bolts 16 and low profile projections 24 instead of longer projections having threaded ends, a considerable economic saving is achieved.

The moulding of plastic superstructures has proved difficult in the past, as mentioned above, because of the problems involved in avoiding thick sections while at the same time providing adequate strength. Stress-cracking problems often occur when wall sections exceed one fifth of an inch in thickness an it is therefore desirable to make the maximum wall thickness one fifth of an inch or less and more preferably one eighth of an inch or less. Further difficulty has been produced because of the tendency of the plastic to "creep" or shrink after the mouldng step. In the embodiment of the invention shown in the drawings, a sufficiently strong superstructure is provided and at the same time a generally even wall thickness of 1/5 of an inch or less (usually approximately ⅛ of an inch or less) can be obtained. It has already been stated that thick sections are avoided in the supports 29 and 30 by virtue of the cavities 31 and 32, but thick sections are also avoided in a runner 38 which connects the supports 29 and 30, by means of arches 40 which enable the wall section throughout the whole of the runner 39 to be maintained substantially constant while at the same time avoid any significant reduction in the strength of the runner. The arches also reduce the weight of the skate and the amount of plastic material necessary for fabrication.

The arches 40 can easily be formed, for example, during injection moulding of the superstructure 14 by providing a blank in the injection mould shaped similarly to the blade 12 except that it also has upward projections corresponding to the arches 40. Moreover, by providing a blank of slightly larger size than the blade 12, allowance can be made for the shrinkage of the plastic after the mouldng step has taken place. In other words, the groove 28 formed during the moulding step is advantageously slightly larger than that in the finished product when cooling has taken place.

Desirably, the blank mentioned above also has an upper surface which is concave in transverse cross-section at positions corresponding to the upper edge 26 of the blade 12, so that the groove 28 is formed with a convex longitudinal bead 42 (see FIG. 2) which bears against the upper edge 26 of the blade 12 when the blade is positioned in the groove 28 and the nuts 18 are tightened. The bead 42 extends along the whole length of the groove 28 at positions where the plastic material of the superstructure 14 contacts the upper edge 26 of the blade and its purpose is to round off the upper corners 43 of the groove and space such corners from the sharp corners of the upper edge 26 of the blade. In this manner, the blade is prevented from cutting into the plastic material during normal use of the skate, which could result in weakening of the superstructure.

As shown in FIGS. 1 and 3, the front and rear upper edges of the blade 12 have cut-outs 44 and the superstructure 14 has projections 46 between the walls 34 at the extreme ends of the groove 28, which projections fit snugly within the cut-outs 44 as shown in FIG. 1. The projections 46 help to inhibit "kick-out," and thus they co-operate in this function with the projections 24 and the bolts 16 as previously described. In addition, the projections 46 also provide a safety feature in conjunction with the rounded front and read edges 48 and 50 of the superstructure 14, in that all sharp edges and projections are eliminated at the front and rear of the skate to reduce the possibility of injury caused by the skate to users of the ice.

As can be seen from FIGS. 1 and 3, the nuts 18 are spaced from the upper ends of the post 33 by spring washers 52. The spring washers enable the blade 12 to be firmly held within the groove 28 even if the plastic material of the superstructure shrinks, yields or creeps, by maintaining the tension between the nuts 18 and the post 33. In this way, the tension can be maintained even if the plastic material should creep by as much as 0.01 inch. However, it should be realised that the nuts 18 and washers 52 can be replaced by any other suitable attachment means for securing the ends of the bolts 16. The concave curvature of the upper edge 26 of the blade previously mentioned facilitates the fitting of the blade 12 into the superstructure 14, because it has been found that the upper surface of the groove 28 is less likely to warp as the plastic material cools when it has a slight convex curvature.

Figure 5:
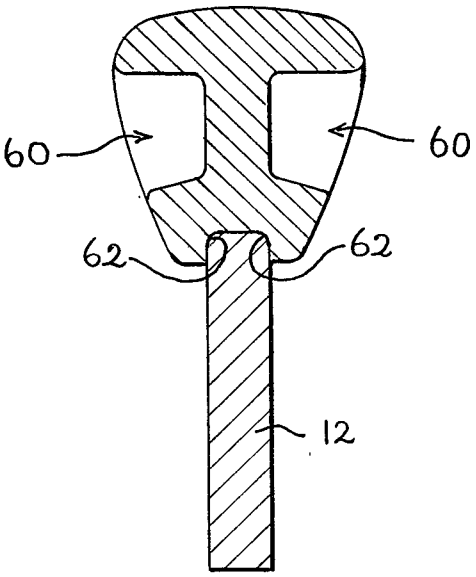
FIG. 5 is an enlarged transverse cross-sectional view of the skate shown in FIG. 4 in the vertical plane indicated by V—V in FIG. 4, but with parts beyond this section not shown.
Figure 4:
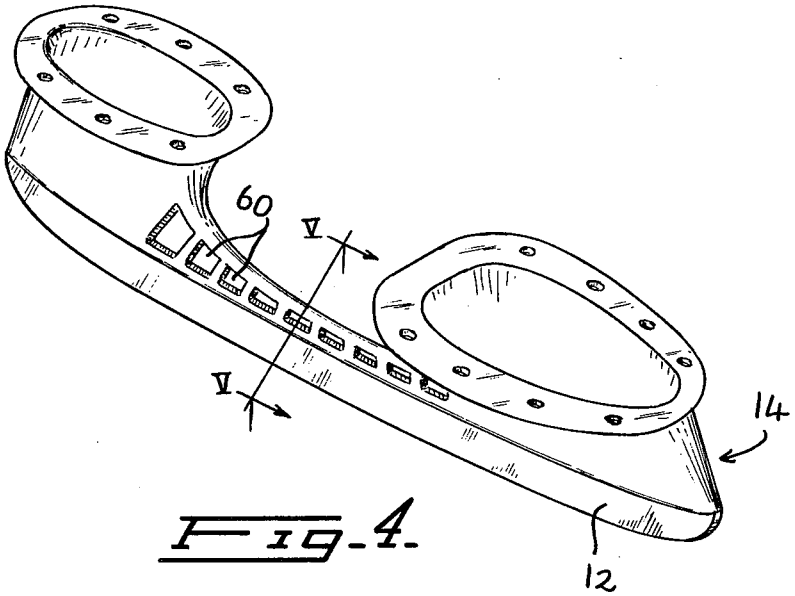
FIG. 4 is a perspective view of a second embodiment of the skate of the invention.

A second preferred embodiment of the invention is shown in FIGS. 4 and 5. In this embodiment, an even wall thickness is achieved in the runner 38 by means of cavities 60 instead of the internal arches 40 of the previous embodiment. The cavities 60 extend in a row on each side of the skate from the heel support 30 to the toe support 29, as shown. This embodiment achieves a more even wall thickness especially in the region of the upper part of the blade, which provide stress-free parts from the mould. The cavities 60 also add to the decorative appearance of the skate.

In this embodiment, weakening of the superstructure 14 in the vicinity of the upper edge 26 of the blade 12 is prevented or reduced by rounding off the corners of the blade as at 62 so that there are no sharp edges to cut into the plastic material.

As mentioned above, in this invention the blade can be made of any suitable material but it is especially preferable to use stainless steel. Stainless steel is not used to form the blades of conventional skates, mainly because it is difficult to weld this material onto metal superstructures. However, stainless steel has the considerable advantage that rusting will not take place, so that the appearance and durability of the blade are improved, while at the same time, the blade requires less care and attention. Additionally, the high chromium carbide content of stainless steel gives the steel good abrasion resistance so that the blade holds its edge longer and thus requires sharpening less often. For this reason also, the blade requires less attention and is likely to last longer since the life of a blade is often determined by the number of times it is sharpened. In fact, a high chromium steel can be used which is similar to that used for razor blades in order to optimise the sharpening and edge retention properties of the blade.

I claim:

1. An ice skate comprising:

a. an elongated blade having an ice-engaging edge and an upper edge opposite the ice-engaging edge;

b. a superstructure made of plastic material for holding the blade, said superstructure defining a groove for receiving said upper edge of the blade;

c. a plurality of bolts for attaching the blade to the superstructure, each bolt having an enlarged head;

d. a plurality of recesses in the blade defined by said upper edge for receiving and retaining said enlarged heads of the bolts;

e. means for retaining said bolts under tension in said superstructure when said upper edge is located in said groove, whereby said blade is firmly held in said groove by said bolts; and f. wherein the ends of said bolts remote from said heads are threaded, and said retaining means comprise threaded nuts which can be screwed onto said ends and which can be tightened against said superstructure to hold said bolts in place under tension.

2. An ice skate according to claim 1 wherein spring washers are positioned between said nuts and the adjacent superstructure.

3. An ice skate according the claim 1 wherein the upper edge of the blade defines a plurality of projections of low profile.

4. An ice skate according to claim 3 wherein said recesses are formed in said projections.

5. An ice skate according to claim 1 wherein the extreme ends of said upper edge have cut-out portions which form recesses in the blade and said superstructure has projections at the ends of said groove which engage within said cut-out portions.

6. An ice skate according to claim 1 wherein said enlarged heads are generally of flat triangular shape and said recesses are of substantially the same shape, said heads fitting snugly within said recesses.

7. An ice skate according to claim 1 wherein a part of the superstructure defining the edge of the groove which contacts said upper edge of the blade is convex as seen in transverse cross-section.

8. An ice skate according to claim 1 wherein said upper edge of the blade is curved in the longitudinal direction and parts of the superstructure defining the groove are correspondingly curved so that the upper edge of the blade fits closely within the groove.

9. An ice skate according to claim 1 wherein said superstructure comprises an upwardly extending toe support, an upwardly extending heel support spaced from said toe support, and an elongated runner extending along said blade between said toe support and said heel support.

10. An ice skate according to claim 9 wherein said toe support and said heel support each comprise wall members defining an internal cavity, and said runner comprises wall members defining a plurality of internal cavities which open into said groove, all of said wall members being of one fifth of an inch in thickness or less.

11. An ice skate according to claim 9 wherein said toe support and said heel support each comprise wall members defining an internal cavity, and said runner comprises wall members defining a plurality of external cavities extending in a row from said heel support to said toe support, all of said wall members being of 1/5 of an inch in thickness or less.

12. An ice skate according to claim 1 wherein said blade is made of stainless steel.

13. An ice skate according to claim 1 wherein the superstructure comprises walls of generally even thickness of one fifth of an inch or less.

14. An ice skate according to claim 1 wherein the superstructure comprises walls of generally even thickness of one eighth of an inch or less.

15. A blade for a skate superstructure made of plastic material, said blade comprising an ice-engaging edge and an upper edge opposite to the ice-engaging edge, said upper edge defining a plurality of recesses for receiving and retaining the enlarged heads of bolts, wherein said upper edge defines a plurality of projections of low profile.

16. A blade according to claim 15 wherein said recesses are formed in said projections.

17. A blade according to claim 15 wherein the extreme ends of said upper edge have cut out portions which form recesses in the blade.

18. A blade according to claim 15 wherein said recesses are of substantially triangular shape.

19. A blade according to claim 15 wherein said upper edge of the blade is curved in the longitudinal direction.

20. An ice skate comprising:

a. an elongated blade having an ice-engaging edge and an upper edge opposite the ice-engaging edge;

b. a superstructure made of plastic material for holding the blade, said superstructure defining a groove for receiving said upper edge of the blade, and wherein the part of the superstructure defining the edge of the groove which contacts said upper edge of the blade is convex when viewed in transverse cross-section; and c. means for firmly holding said blade in said superstructure.

21. An ice skate comprising:

a. an elongated blade having an ice-engaging edge and an upper edge opposite the ice-engaging edge;

b. a superstructure made of plastic material for holding the blade, said superstructure defining a groove for receiving said upper edge of the blade, and wherein the extreme ends of said upper surface of the blade have cut-out portions which form recesses in the blade and said superstructure has projections at the ends of the groove which are received within said cut-out portions; and c. means for firmly holding said blade in said superstructure.

* * * * *